US005236265A

United States Patent [19]

Saito et al.

[11] Patent Number: 5,236,265

[45] Date of Patent: Aug. 17, 1993

[54] PORTABLE PRINTER WITH VARIABLE HOUSING CONFIGURATIONS

[75] Inventors: Yukio Saito, Fukushima; Masayoshi Otsuka, Date; Tomoyuki Nagamine, Fukushima; Masaki Okuyama, Fukushima; Isao Nakamura, Fukushima, all of Japan

[73] Assignee: Fujitsu Isotec Limited, Tokyo, Japan

[21] Appl. No.: 836,292

[22] PCT Filed: Jun. 26, 1991

[86] PCT No.: PCT/JP91/00860

§ 371 Date: Feb. 28, 1992

§ 102(e) Date: Feb. 28, 1992

[87] PCT Pub. No.: WO92/00197

PCT Pub. Date: Jan. 9, 1992

[30] Foreign Application Priority Data

Jun. 28, 1990 [JP] Japan ..... 2-170669
Jan. 29, 1991 [JP] Japan ..... 3-009403

[51] Int. Cl.[5] ..... B41J 3/36

[52] U.S. Cl. ..... 400/88; 400/208; 400/680; 400/693; 400/693.1; 312/208.1; 312/208.3; 312/208.4; 361/807; 361/725; 361/730

[58] Field of Search ..... 400/82, 88, 691, 692, 400/693, 693.1, 680, 682, 685, 196, 208; 312/208.1, 208.2, 208.3, 208.4; 361/390, 391, 392, 393, 394, 395, 417

[56] References Cited

U.S. PATENT DOCUMENTS

| | | | |
|---|---|---|---|
| 1,246,203 | 11/1917 | Willman | 312/208.4 |
| 3,711,175 | 1/1973 | Sottsass, Jr. | 312/208.4 |
| 3,940,758 | 2/1976 | Margolin | 400/88 |
| 4,634,304 | 1/1987 | Narushima et al. | 400/691 |
| 4,645,275 | 2/1987 | Pucci | 400/88 |
| 4,725,157 | 2/1988 | Narai et al. | 400/88 |
| 5,105,210 | 4/1992 | Hirano et al. | 400/680 |
| 5,111,216 | 5/1992 | Richardson et al. | 400/88 |

FOREIGN PATENT DOCUMENTS

| | | | |
|---|---|---|---|
| 0219624 | 4/1987 | European Pat. Off. . | |
| 415608 | 7/1910 | France . | |
| 1034539 | 7/1951 | France . | |
| 53-157639 | 12/1978 | Japan . | |
| 55-134644 | 9/1980 | Japan . | |
| 56-95848 | 7/1981 | Japan . | |
| 58-194046 | 12/1983 | Japan . | |
| 60-170858 | 11/1985 | Japan . | |
| 61-74870 | 4/1986 | Japan . | |
| 61-112942 | 7/1986 | Japan . | |
| 62-134154 | 8/1987 | Japan . | |
| 63-238 | 1/1988 | Japan . | |
| 0060772 | 3/1988 | Japan | 400/88 |
| 0197682 | 8/1988 | Japan | 400/88 |
| 1-100218 | 7/1989 | Japan . | |
| 2-45199 | 2/1990 | Japan . | |
| 0689940 | 4/1953 | United Kingdom | 312/208.4 |

*Primary Examiner*—Eugene H. Eickholt
*Attorney, Agent, or Firm*—Staas & Halsey

[57] ABSTRACT

The present invention relates to a portable printer suitable for hand-carrying and transporting, and provides a portable printer which is easily carried and transported and provides less possibility of damage to the printing mechanism, and comprises a plurality of casings 1, 2, a printing mechanism 10 housed in the casing 1, 2 for performing a printing of a paper 100, and connecting means 3 for connecting the plurality of casings 1, 2 by mating wider surfaces 1*a* and 2*a* among outer surfaces of the casings 1, 2 when a printing of the paper 100 by the printing mechanism 10 is performed, and when a printing is not performed, the relative positional relationship of the plurality of casings 1, 2 can be varied to form an essentially flat configuration overall. With this construction, when a printing of the paper 100 is performed by the printing mechanism 10, the plurality of casings 1 and 2 are connected by mating the wider surfaces 1*a* and 2*a* of the outer surfaces of the casings 1 and 2 by the connecting means, and when a printing is not performed, the relative positional relationship of the plurality of casings 1, 2 is changed so that the plurality of casings 1, 2 form an essentially flat configuration overall. In either case, the printing mechanism 10 is housed within the casing and is not externally exposed.

21 Claims, 16 Drawing Sheets

PORTABLE PRINTER WITH VARIABLE HOUSING CONFIGURATIONS

TECHNICAL FIELD

The present invention relates to a portable printer able to be carried and transported by hand.

The wide-spread use of portable type personal computers and word-processors has led to a growing need for portable printers that can be conveniently carried and transported by hand.

To provide a good portability and transportability thereof, a printer able to be carried and transported by hand must have a spatial configuration, in addition to being made compact and light weight.

BACKGROUND ART

Typical conventional printers having detachable printer heads are known, but it is not possible to change the configurations of these printer bodies per se, since the casings of the printer bodies are formed integrally as a one-body construction.

A small printer is known, however, in which the casing thereof can be separated into two sections, i.e., upper and lower sections, to be freely openable and closable, and thus can perform a printing of normal papers and of passbooks or bankbooks. A printer head and a first paper feeder roller are provided in the upper casing side, and a platen and a second paper feeder roller are provided in the lower casing side. (Japanese Examined Patent Publication No. 63-238)

The general type of printers having an overall configuration which cannot be changed must be carried or transported as when used, and therefore, are not suitable for hand-carrying or transporting wherein there is a strict requirement for a spatial configuration thereof convenient for carrying and transporting same.

Even the openable and closable type printer described above, must be carried or transported in the form similar to that when used for printing, and thus it is not truly convenient for carrying and transporting.

Further, in the openable and closable type printer, when the casing is opened, a wide gap exists between the printer head and the platen, allowing an external exposure of the delicate printing mechanism. This creates the possibility that the operator may touch the electronic elements and damage same, or foreign matter may enter therein to cause damage to the mechanism.

SUMMARY OF THE INVENTION

The present invention is intended to solve the above-mentioned problems of the prior art. Therefore, an object of the present invention is to provide a portable printer which can be easily and conveniently hand-carried or transported and in which the possibility of damage to the printing mechanism thereof is lowered.

To accomplish the above-mentioned object, a portable printer according to the present invention, as exemplified in FIG. 1, comprises a plurality of casings 1, 2, a printing mechanism 10 housed within the casings 1, 2 for performing a printing on a paper 100, and a connecting means 3 for connecting the plurality of casings 1, 2 by mating wider surfaces 1*a* and 2*a* among the outer surfaces of the respective casings 1, 2, when a printing on the paper 100 by the printing mechanism 10 is performed, and when a printing is not performed, the relative positional relationship to each other of the plurality of the casings 1, 2 can be varied, to thus form an essentially flat single-body configuration thereof overall.

The plurality of casings 1, 2 can be connected by the connecting means 3 such that the plurality of casings 1, 2 have an essentially flat configuration overall when having a single body construction when a printing on the paper 100 is not performed.

Further, the portable printer according to the invention may be constructed such that the connecting means 3 connects the plurality of casings 1, 2 for an opening and closing thereof.

Two casings 1, 2 can be provided and these two casings 1, 2 can be connected at the lower ends thereof by the connecting means 3 when a printing is performed.

A dummy connecting means 9, which performs essentially the same action as the connecting means 3 with respect to each of the casings 1, 2, can be provided in parallel to the connecting means 3, and a cable 31 for an electrical connection between the plurality of casings 1, 2 inserted through the dummy connecting means 9.

The connecting means 3 can comprise a twin axle type hinge pivotally journaled on both of the casings 1, 2 to be connected by the connecting means 3. Also, an elastic body 8 can be disposed between the twin axle type hinge 3 and the casings 1, 2, to restrict a free motion of the twin axle hinge 3.

Further, the two casings 1, 2 can be provided with the printing mechanism 10 housed in one of the casings 1 and a paper feed mechanism 20 for feeding the paper 100 housed in the other casing 2. Also, the printing mechanism 10 can be arranged in the casing 1 housing at a downstream side thereof with respect to a feed direction of the paper 100 by the paper feeder mechanism 10, and housing the paper feed mechanism 20 arranged at the upstream side of the casing 2.

Furthermore, condition holding means 37, 38 can be provided for maintaining the condition of the wider surfaces 1*a*, 2*a* of the outer surfaces of the plurality of casings 1, 2 when mated to each other. The condition holding means 37, 38 can comprise a magnet 37 provided on one of the plurality of the casings 1, 2 and a magnetically conductive member 38 provided on the other casing 1, 2.

Further, the magnet 37 can be provided on the one of casings 2 in a recess in the surface thereof, and the magnetically conductive member 38 can be provided on the other casing 1 in such a manner that it can be projected and retracted with respect to the surface thereof.

Furthermore, a paper feed path 7 for passing the paper 100 can be extended through the two casings 1, 2. Also, slits 7*a*, 7*b* can be formed in the wider surface 1*a*, 2*a* of the casings 1, 2 at an intermediate position in the paper feed path 7, in alignment with each other. Among this plurality of slits 7*a*, 7*b*, the slit 7*a* positioned at the downstream side with respect to the paper feed direction has a wider opening than the slit 7*b* positioned at the upstream side thereof.

Also, support means 35, 36 can be provided for supporting the casings 1, 2 when standing, for example, on the floor, at a position in which the wider surfaces 1*a*, 2*a* of the plurality of casings 1, 2 are mated to each other. The support means 35, 36 can be projectably and retractably provided in the casings 1, 2.

Further, a ribbon cassette 14 can be detachably disposed within the casing 1, in which the printing mechanism 10 is housed, and a lid 44 for opening and closing the side wall of the casing 1 to expose the ribbon cassette 14, pivotally mounted on the casing 1, to thus pivot about the vicinity of the lower end thereof.

Also, a power switch 45 can be provided between the casings 1, 2 in such a manner that it is not externally exposed when the casings 1, 2 are formed into the essentially flat configuration overall when in a single-body construction.

Furthermore, a receptacle cover 47 can be provided for receiving the plurality of casings 1, 2 when formed into the flat configuration. Also a partitioning plate 47*a* can be provided for the receptacle cover 47, for partitioning the casings 1, 2 and other associated materials 48.

FIRST EMBODIMENT

An embodiment will be discussed with reference to the drawings.

Figure 1:
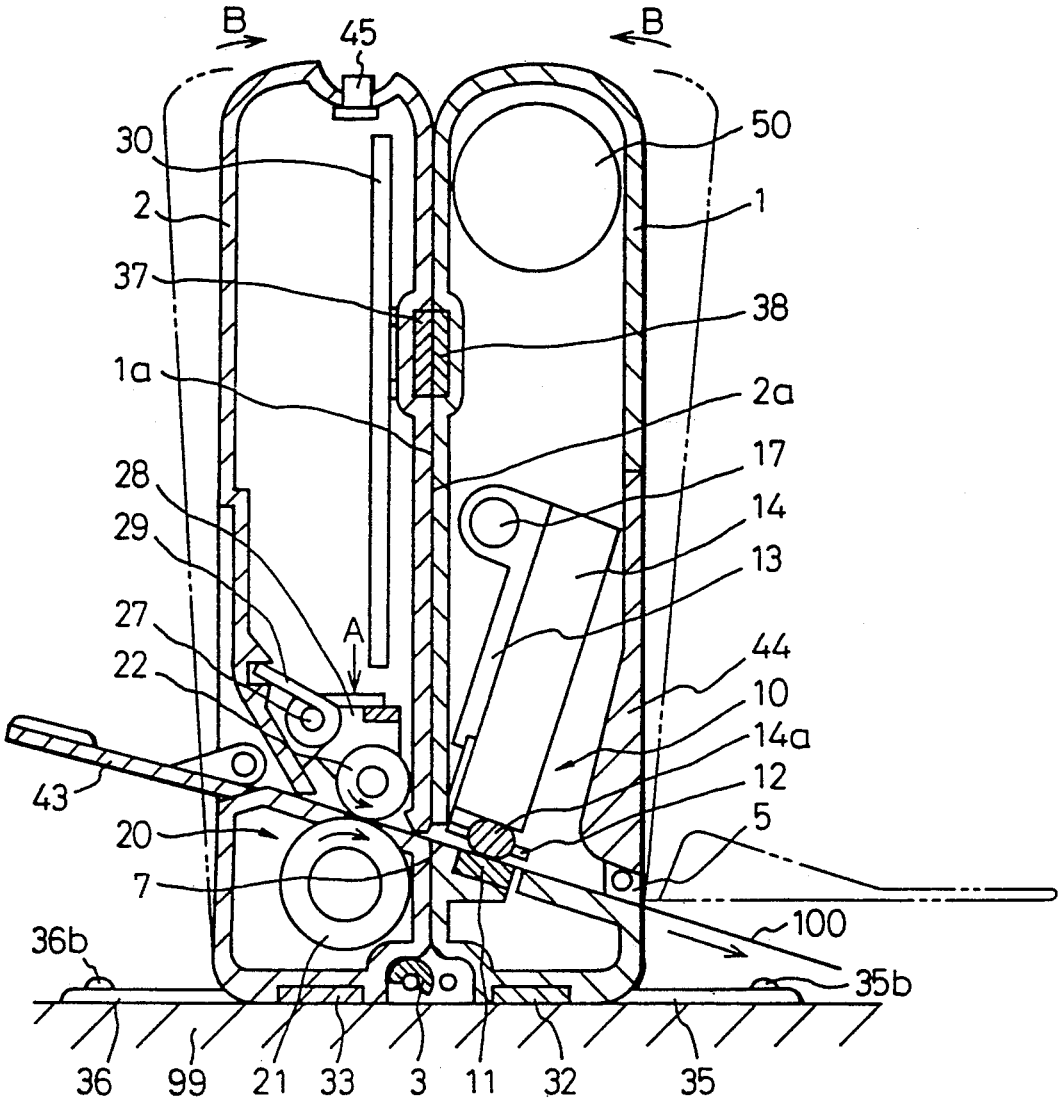
FIG. 1 is a sectional side elevation view of the first embodiment of the present invention when in a condition of use.
Figure 2:
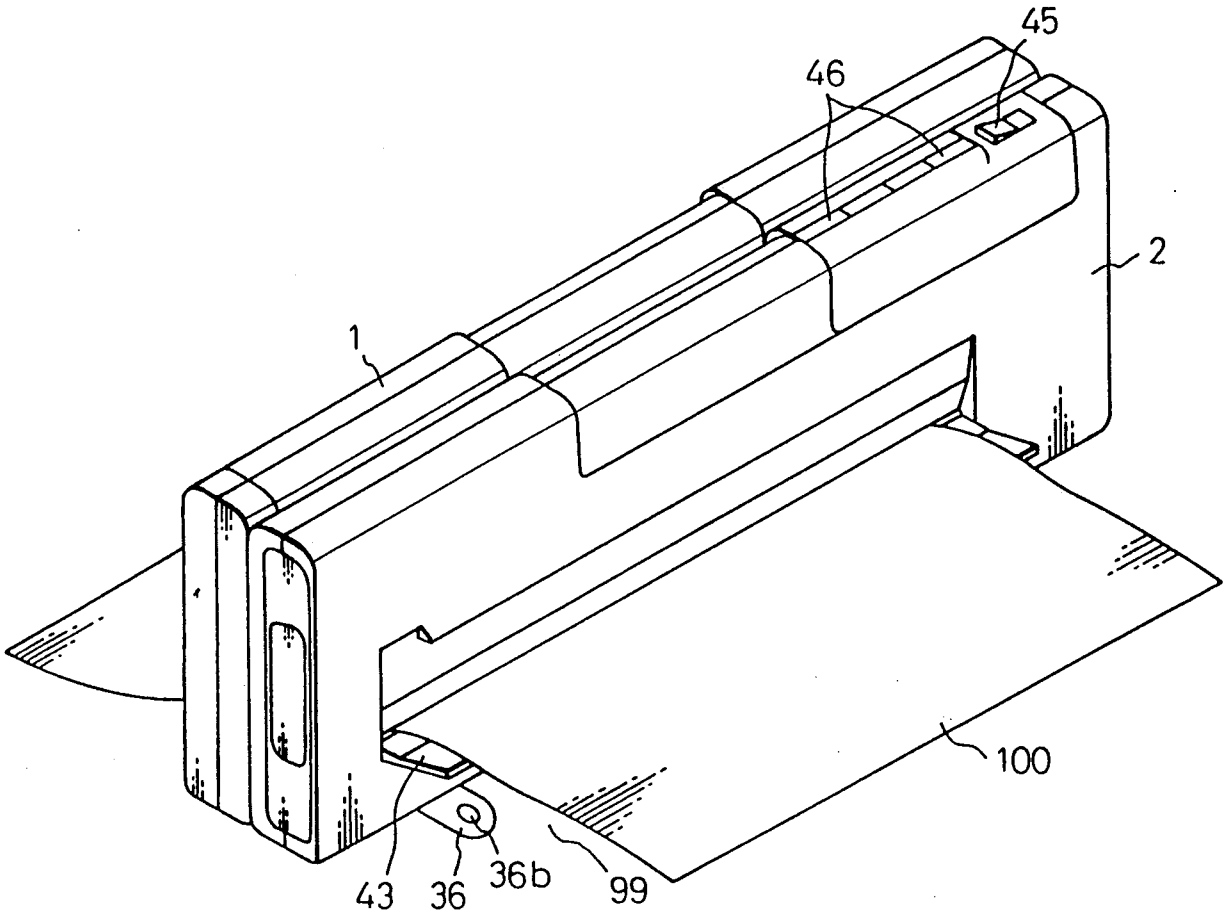
FIG. 2 is a perspective view of the first embodiment of the invention when in a condition of use.
Figure 3:
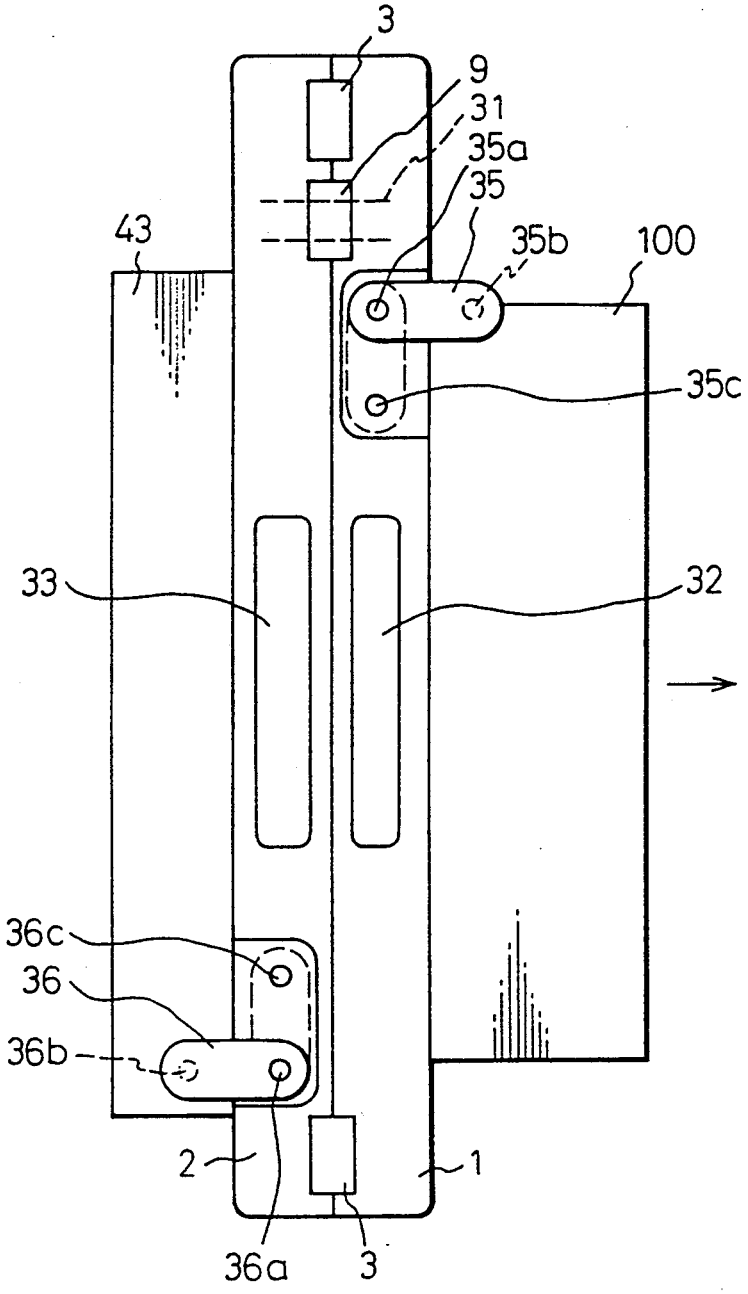
FIG. 3 is a bottom view of the first embodiment of the invention when in a condition of use.
Figure 4:
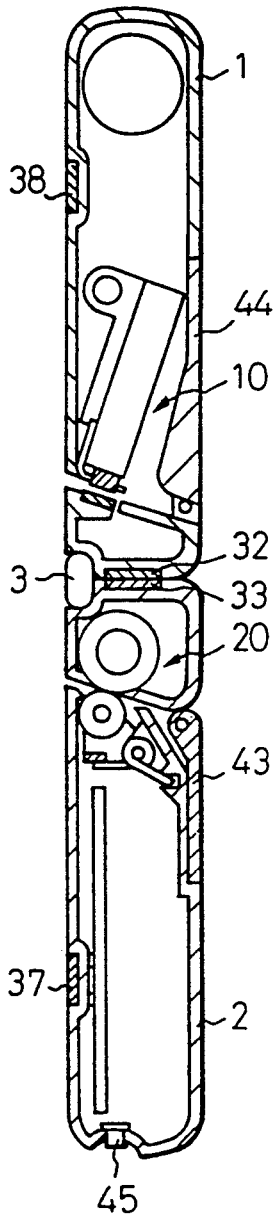
FIG. 4 is a sectional side elevation view of the first embodiment of the invention when in a condition for hand-carrying.
Figure 5:
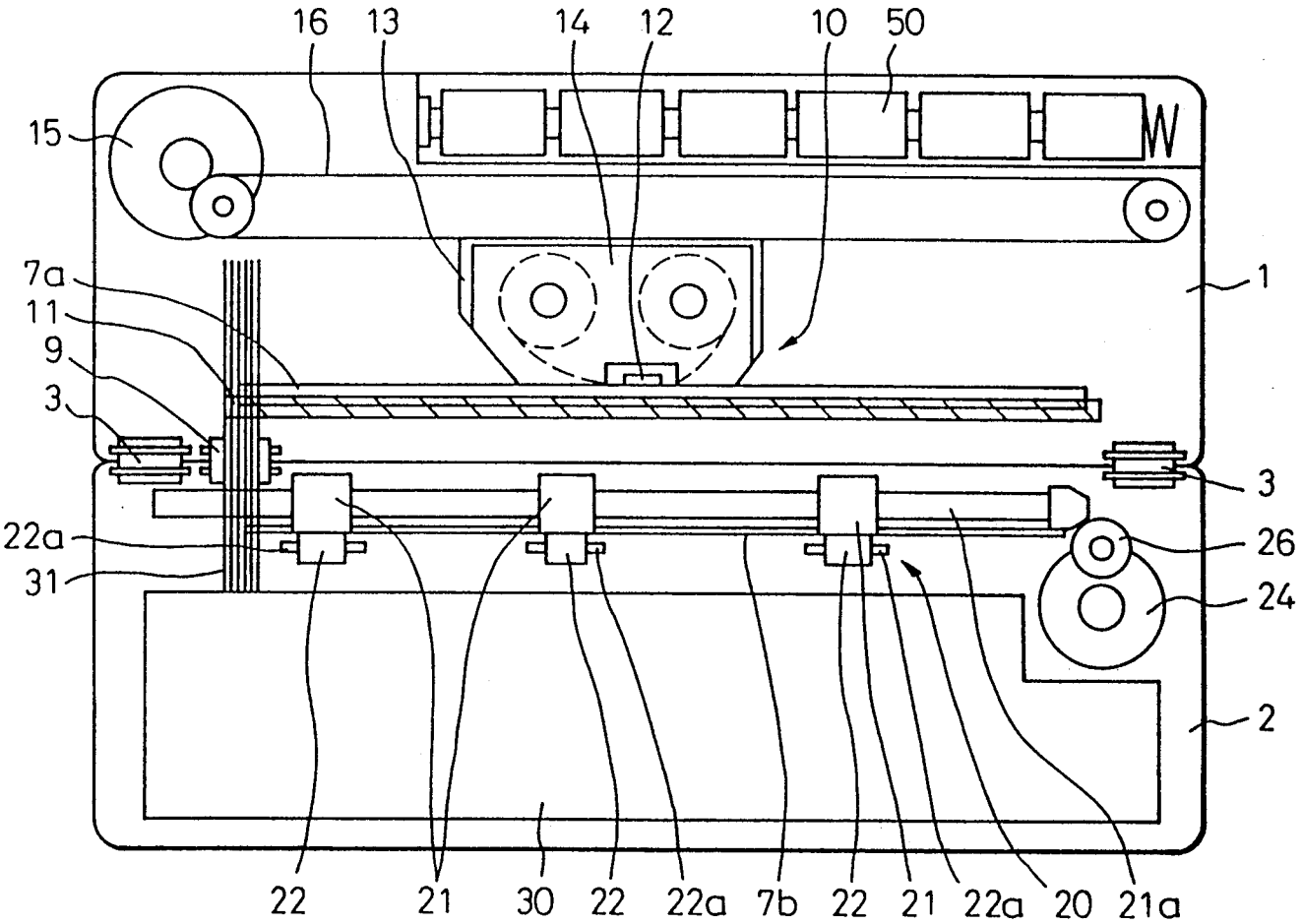
FIG. 5 is a schematic and transparent front elevation view of the first embodiment of the invention when in the condition for hand-carrying.
Figure 6:
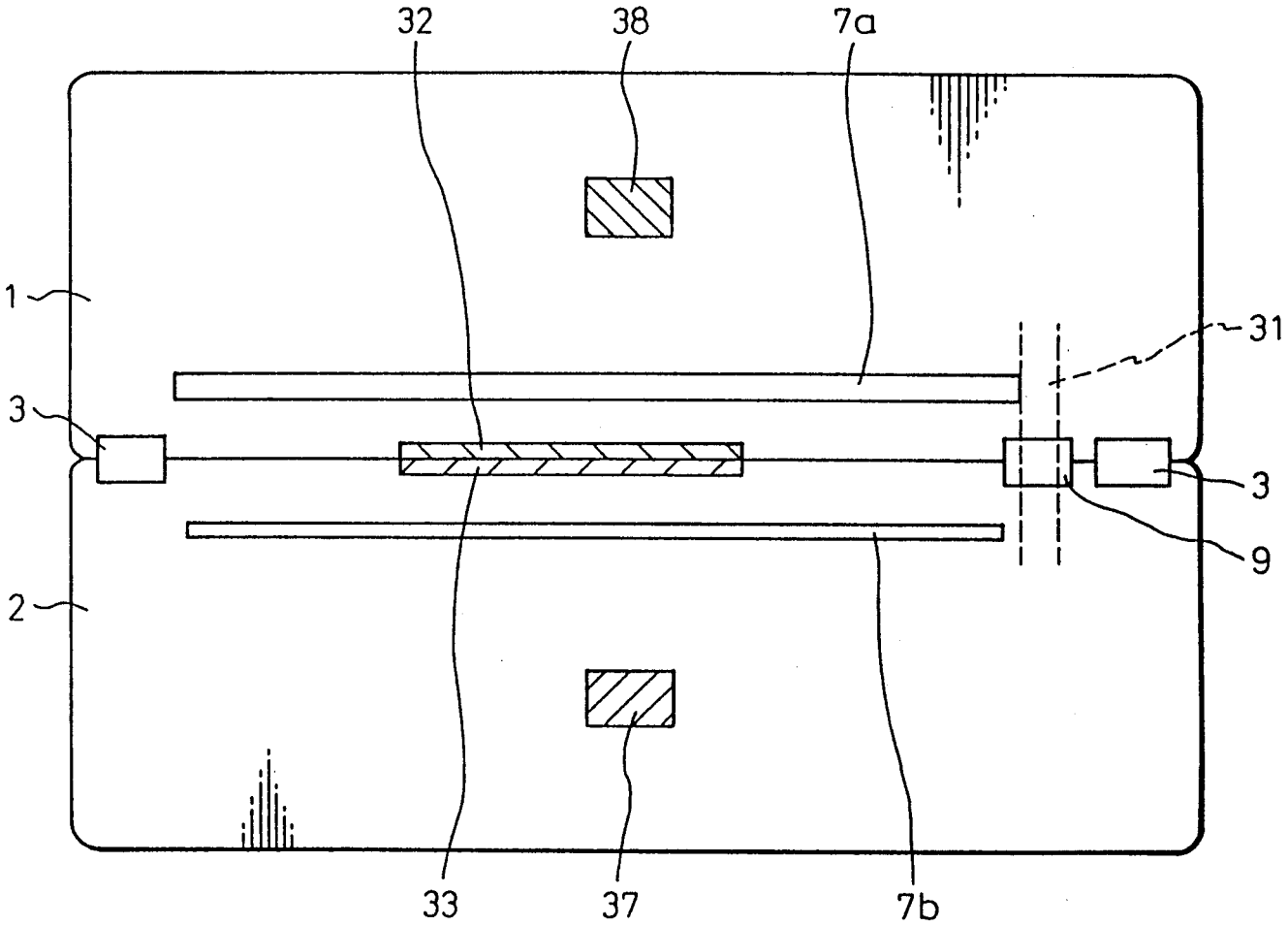
FIG. 6 is a back elevation view of the first embodiment of the invention when in the condition for hand-carrying.

FIG. 1 through 14 show the first embodiment of the present invention, wherein FIGS. 1 to 3 illustrate a condition in which a portable printer is used for printing, and FIGS. 4 to 6 illustrate a condition in which the portable printer is not to be used but is to be transported or stored.

As shown in the respective figures, the portable printer is externally covered with first and second mutually independent casings 1 and 2. These two casings 1 and 2 are connected to each other by hinges 3, for a relative pivotal motion thereof with respect to each other.

As shown in FIGS. 1 and 5, a printing mechanism 10 and batteries 50 are disposed within the first casing 1, and a paper feed mechanism 20 and a control circuit board 30 are disposed within the second casing 2.

The overall construction of the printing mechanism 10 is housed in the first casing 1. Namely, a platen 11 and a guide shaft 17 parallel thereto are rigidly secured in the first casing 1 and a carriage 13 slidably supported on the guide shaft 17 is driven for a reciprocating motion thereof along the guide shaft 17 by a space motor 15 via a drive belt 16.

A printing head 12 is mounted on the carriage 13 in opposition to the platen 11, and a ribbon cassette 14 is detachably mounted on the carriage 13 such that an inked ribbon 14*a* lies between the printing head 12 and the platen 11.

With this construction, when the carriage 13 is driven by the space motor 15, the printing head 12 travels along the platen 11, while maintaining the opposing relationship thereof with the platen 11, to perform a printing of one line.

Further, the overall construction of the paper feeder mechanism 20 is housed in the second casing 2. Namely, three pairs of paper feed rollers 21 and 22 are mounted on rotary shafts 21*a* and 22*a* in the second casing 2, and among these rollers 21, 22, the primary drive rollers 21 are rotatingly driven by a line feed motor 24 via a gear mechanism 26.

Furthermore, idling rollers 22 are rotatably mounted on an arm 28 pivotally supported within the second casing 2 for a pivotal motion about a shaft 27. The arm 28 is biased in a direction represented by the arrow A by a spring 29, and accordingly, the idling rollers 22 are pressed onto the primary drive rollers 21 and rotated therewith. Note, the arm 28 and the spring 29 are not shown in FIG. 5.

The control circuit board 30 fixedly secured within the second casing 2, occupies a large space within the second casing 2 and outputs a variety of signals to the space motor 15, the printing head 12, the line feed motor 24 and so forth, through a flexible cable 31.

Reference numeral 45 denotes a power switch of the portable printer, arranged in a recess formed in the second casing 2 such that it does not project from the surface of the second casing 2. Reference numeral 46 shown in FIG. 2 denotes various operation switches for a printing intensity control, line feed, on-line/off-line, and so forth.

The first and second casings 1 and 2 constructed as set forth above are connected to each other by a pair of the hinges 3, for a relative pivotal movement thereof, whereby the first and second casings 1 and 2 can be opened and closed relative to each other.

While in use, i.e., while performing a printing on a paper 100 by the printing mechanism 10, the casings 1 and 2 are placed in a closed position by mating wider surfaces 1*a* and 2*a* among the external surfaces thereof, as shown in FIGS. 1 to 3. This position will be hereafter referred to as the "closed position".

At this time, the casings 1 and 2 are connected to each other at the inner sides of the lower ends by the hinges and placed vertically on a desk (floor) 99. Accordingly, even when the casings 1 and 2 are slightly opened as shown by the two dotted line in FIG. 1, the casings 1 and 2 will move in a closing direction (arrow B) thereof under their own weight, to thereby maintain the closed position thereof, as long as the center of gravity of each casing 1 and 2 is maintained inside of the outer end of legs 35 and 36 discussed later. Also, in this closed position, the switches including the power switch 85 are positioned at the upper side thereof.

While not in use, i.e., when carried and transported, the casings 1 and 2 can be opened to an angle of 180°, as shown in FIGS. 4 to 6. Since the casings 1 and 2 both have substantially the same thickness, when in the flat position they form a construction of an A4 size, for example, overall, and thus can be held in the hand or can be placed in a bag for facilitating a carrying or transporting thereof. Also, this position facilitates a storage thereof requiring less space. This position will be hereafter referred to as the "open position".

On the external surfaces of the casings 1 and 2, which are mated to each other when in the open position, a permanent magnet 32 is secured to one of the surfaces and a steel plate 33 is secured to the other surface thereof. Therefore, when in the open position, due to an attraction force between the permanent magnet 32 and the steel plate 33, the casings 1 and 2 are maintained in the open position. Thereafter, by exerting a predetermined magnitude of force in the closing direction, the casings 1 and 2 can be folded into the closed position Even in the open position, the printing mechanism 10 constituted of the platen 11 and the printing head 12 and so forth is not separated but is maintained as one body housed in the first casing 1. Therefore, the opposing faces of the platen 11 and the printing head 12 and so forth, are not externally exposed.

Figure 7:
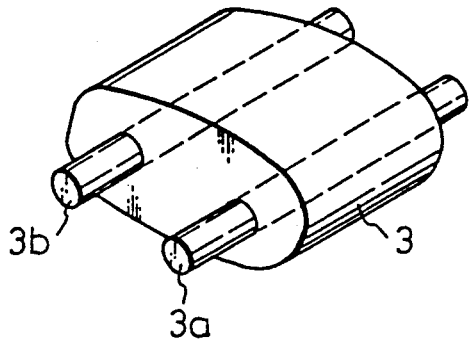
FIG. 7 is a perspective view of a pivot portion in the first embodiment of the invention.

For a pivotal connection of the casings 1 and 2 by the hinges, a twin axle hinge, in which two axles **3*a* and 3*b* are extended in a parallel relationship as shown in FIG. 7**, is employed.

Figure 8:
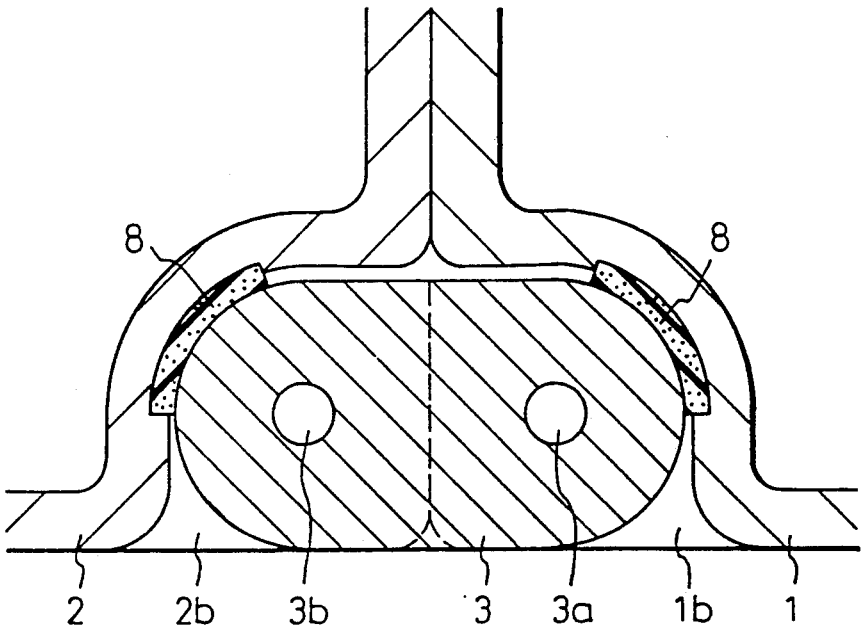
FIG. 8 is a sectional view of the pivot portion in the first embodiment of the invention.

As shown in FIG. 8, the hinges 3 are received in recesses **1*b* and 2*b* of the casings 1 and 2 such that they do not project from the outer surfaces of the casings 1 and 2. The first axle 3*a* is supported on the first casing 1 and the second axle 3*b* is supported on the second casing 2. Accordingly, the hinges 3 are respectively journaled on the casings 1 and 2, for a rotation thereof. Further, in either the closed position or the open position, the hinges 3 hold the casings 1 and 2** in close contact with each other such that a space therebetween is not formed.

Furthermore, as shown in FIG. 8, the recesses **1*b* and 2*b* of the casings 1 and 2 are provided with pieces of an elastic felt 8, in such a manner that they are sandwiched between the surfaces of the hinges 3. Accordingly, the hinges 3 are constantly biased by the elastic force of the felt 8**, to thereby restrict any free movement thereof and prevent play while in motion, and to eliminate noise.

As shown in FIGS. 3, 5 and 6, a cable guide 9 is provided between the casings 1 and 2, and a flexible cable 31 is passed therethrough. The cable guide 9 is extended in parallel to the hinges 3.

Figure 9:
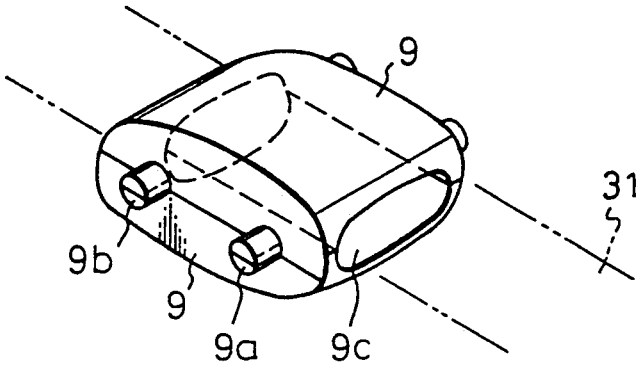
FIG. 9 is a perspective view of a cable guide in the first embodiment of the invention.

As shown in FIG. 9, the cable guide 9 has essentially the same external configuration as the hinges 3 and forms a dummy hinge (dummy connecting means) journaled on each casing by axles **9*a* and 9*b* for a rotation thereof, in the same way as the hinges 3. The cable guide 9 is separated into upper and lower parts at a straight line extending through the center of the axles 9*a* and 9*b*, and a groove 9*c* is formed on the separated surface and the cable guide 9** is passed through the inner side thereof.

Figure 10:
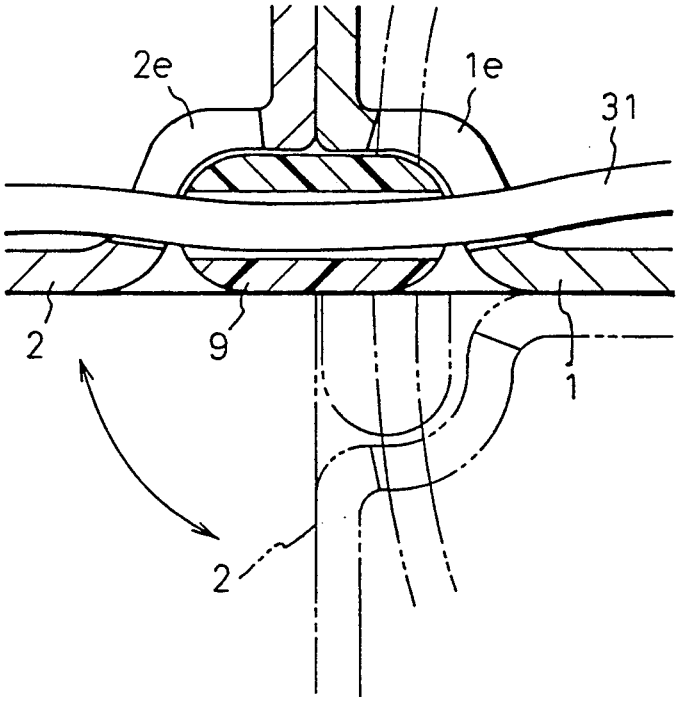
FIG. 10 is a sectional view of the cable guide in the first embodiment of the invention.

As shown in FIG. 10, holes **1*e* and 2*e* are formed in the wall sections of the respective casings 1 and 2 adjacent to the cable guide 9, so that the flexible cable 31** can be passed therethrough.

Accordingly, since the flexible cable 31 is not externally exposed, an enhanced external appearance can be provided. Furthermore, during an opening and closing of the casings 1 and 2, the flexible cable 3 will not be subjected to tension or bending by the casings 1 and 2, and thus no stress will be exerted on the flexible cable 31. Also, the flexible cable 31 will not interfere with the opening and closing of the casings 1 and 2.

Returning to FIG. 1, on the wider surfaces **1*a* and 2*a* of the casings 1 and 2, which are mated to each other in the closed position, a permanent magnet 37 is secured to one of the surfaces and a steel strip 38 is secured to the other surface. In the closed position, the attraction force between the permanent magnet 37 and the steel strip 38 maintains the casings 1, 2 in the closed position, and exerting a predetermined force in the opening direction (opposite direction to the arrow B), the casings 1 and 2** can be placed in the open position.

Figure 11:
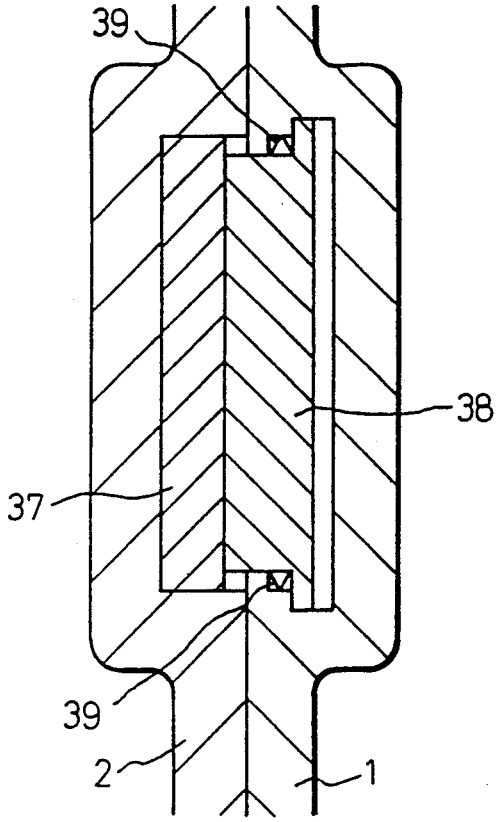
FIG. 11 is a enlarged partial sectional view of the first embodiment of the invention.

It should be noted that, as shown in FIG. 11, the permanent magnet 37 is provided on the surface of the casing 2 in a recess therein to avoid a direct contact with other items holding magnetically recorded data, such as a cash card, telephone card and so forth.

On the other hand, the steel strip 38 is biased inward by a weak spring 39 so that it does not extend from the surface of the casing 1 in the open position. In the closed position, however, the steel strip 38 extends from the surface of the casing 1 against the force of the spring 39, to be engaged with the permanent magnet 37.

If the spring 39 has too large a biasing force, and accordingly, the permanent magnet 37 cannot draw out the steel strip 38 for engagement, the steel strip 38 can be moved to the engaged position with the permanent magnet 37 by a push button not shown.

As shown in FIG. 3, the legs 35 and 36 are respectively provided on respective bottom surfaces of the casings 1 and 2 in the closed position. The respective legs 35 and 36 are able to rotate by 90°. The casings 1 and 2 are provided with recesses having depths corresponding to the thickness of the legs 35 and 36 at the leg mounting sections, so that the bottom faces of the legs 35 and 36 are positioned flush with the bottom surface of the casings 1 and 2.

The legs 35 and 36 are respectively extended outwardly, as shown by the solid line, when the casings 1 and 2 are placed in the closed position. On the other hand, when the casings 1 and 2 are in the open position, they are retracted and do not project from the casings 1 and 2. To maintain the retracted position, click fasteners are formed by projections **35*b* and 36*b* on the legs 35 and 36 and recesses 35*c* and 36*c* in the casings 1 and 2**.

Returning to FIG. 1, the paper feed paths 7 for feeding the paper 100 are formed in the casings 1 and 2 such that they are aligned in the closed position of the casings 1 and 2.

In this embodiment, a push-in type paper feed, in which the paper 100 is fed from the paper feed mechanism 20 to the printing mechanism 10, is employed.

Note, it is possible to employ a draw type paper feed, in which the paper fed mechanism 20 is positioned downstream of the printing mechanism 10 with respect to the paper feed direction.

A paper insertion guide plate 43 is provided at the inlet portion of the paper feed path 7 of the second casing 2, for a free opening and closing. Upon printing, the paper 100 can be guided along the paper insertion guide plate 43 in the open position into the paper feed path 7.

The paper feed path 7 is designed to pass the paper 100 between the primary drive roller 21 and the idling roller 22 and between the platen 11 and the printing head 12. Slits *7a* and *7b* having a width allowing the printing paper 100 to pass therethrough are provided in the wider surfaces 1*a* and 2*a*, which are positioned adjacent to and mating with each other at an intermediate position of the paper feed paths 7.

Figure 12:
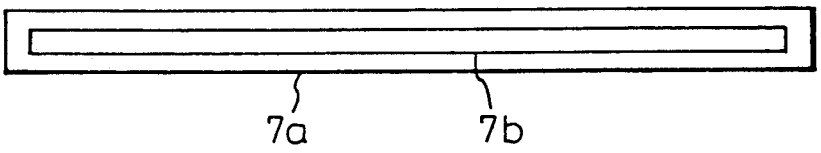
FIG. 12 is a schematic illustration showing a paper feed path slit in the first embodiment of the invention.

As shown in FIG. 12, these slits *7a* and *7b* are shaped such that the slit *7a* in the first casing 1, which is positioned downstream with respect to the paper feed direction, has a wider opening than the slit *7b* of the second casing 2 positioned at the upstream side. Here, for example, the width of the slit *7a* of the first casing 1 is approximately 3 mm and the width of the slit *7b* of the second casing 2 is approximately 1 mm.

Accordingly, when an offset occurs between the casings 1 and 2 in the closed position, a jamming of the paper 100 in the paper feed path 7 will not occur, and thus a smooth feed of the paper 100 from the second casing 2 to the first casing 1 can be achieved.

It should be noted that it is possible to provide no substantial difference in the widths of the slits *7a* and *7b*, but to provide a greater chamfering for the first slit *7a* instead.

With the arrangement set forth above, in the closed position, the paper 100 is driven to run through the paper feed path 7 by the paper feed mechanism 20, and printing is performed on the surface of the paper 100 by the printing mechanism 100.

Figure 13:
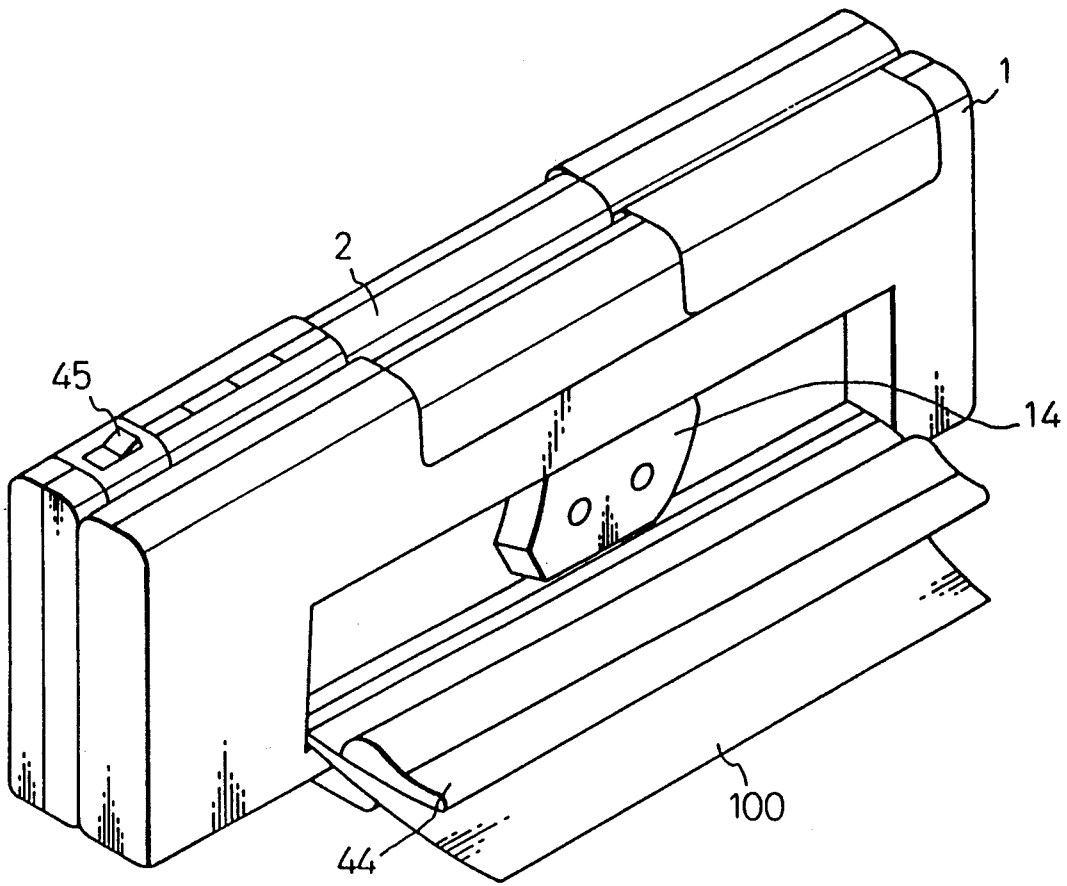
FIG. 13 is a perspective view of the first embodiment of the invention when in a condition for exchanging the ribbon cassette.

FIG. 13 shows a closure lid 44 provided on the outer surface of the first casing 1, in the open position. This position is shown by a two dotted line in FIG. 1.

The closure lid 44 has a size corresponding to the range of travel of the ribbon cassette 14 and has a pivot at the lower end thereof. Accordingly, when the closure lid 44 is open, the upper portion can be widely opened. The ribbon cassette 14 is exposed within the opening, to thus facilitate an exchange of the ribbon cassette 14.

Further, since the lower end of the closure lid 44 forms the paper ejecting opening 5, the printing paper 100 is positioned at the lower side of the closure lid 44 when the closure lid 44 is open. Accordingly, when the ribbon cassette 14 is exchanged midway in the printing operation, the paper 100 will not be touched, and thus will not be shifted from the printing position.

Figure 14:
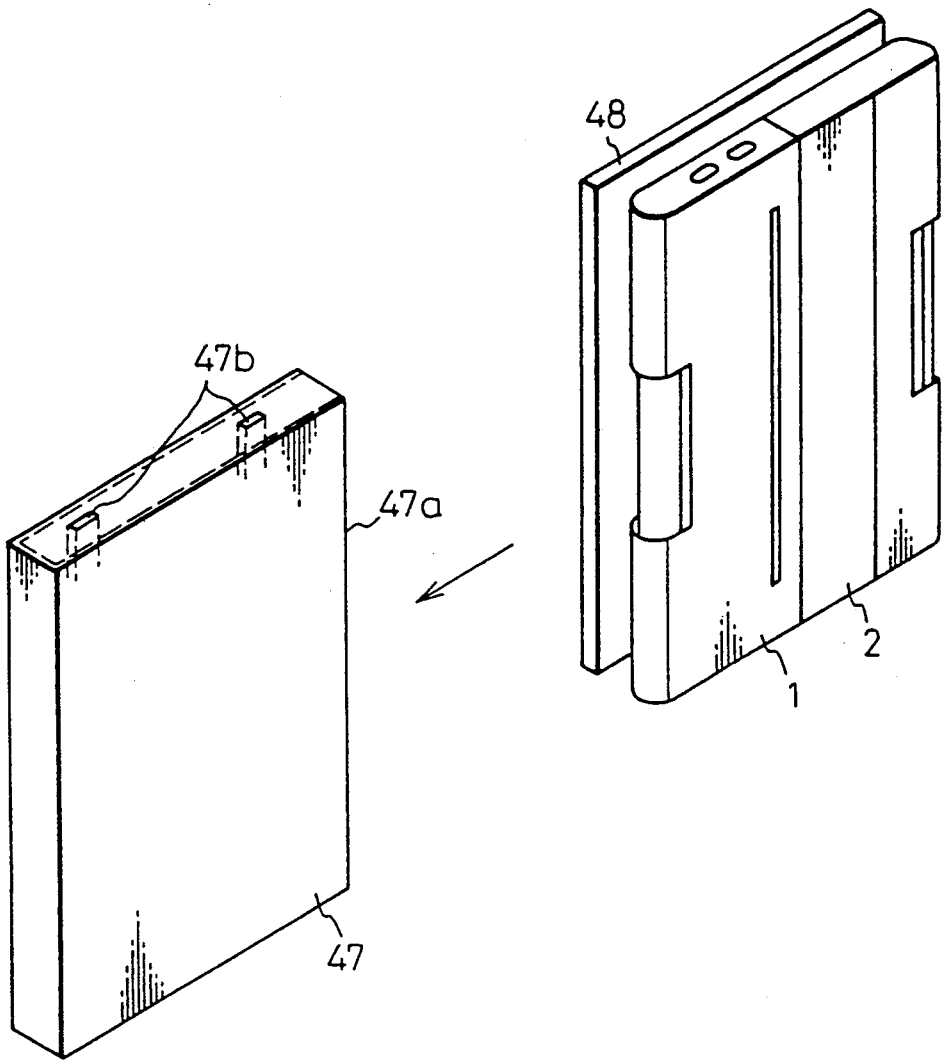
FIG. 14 is a perspective view of a receptacle cover in the first embodiment of the invention.

FIG. 14 shows the receptacle cover 47 for housing the portable printer 1 and 2 in the open position. The receptacle cover 47 has a thin box-shaped A4 size configuration and has one open side face 47*a* through which the portable printer in the open position can be accommodated therein and removed therefrom.

Further, a partitioning plate 47*b* is provided in the receptacle cover 47, to position the portable printer, and associated items 48, such as an instruction manual and so forth, separately by the partitioning plate 47*b*.

When the portable printer is accommodated in the receptacle cover 47, the carrying and transporting thereof becomes easier and safer.

SECOND EMBODIMENT

Figure 15:
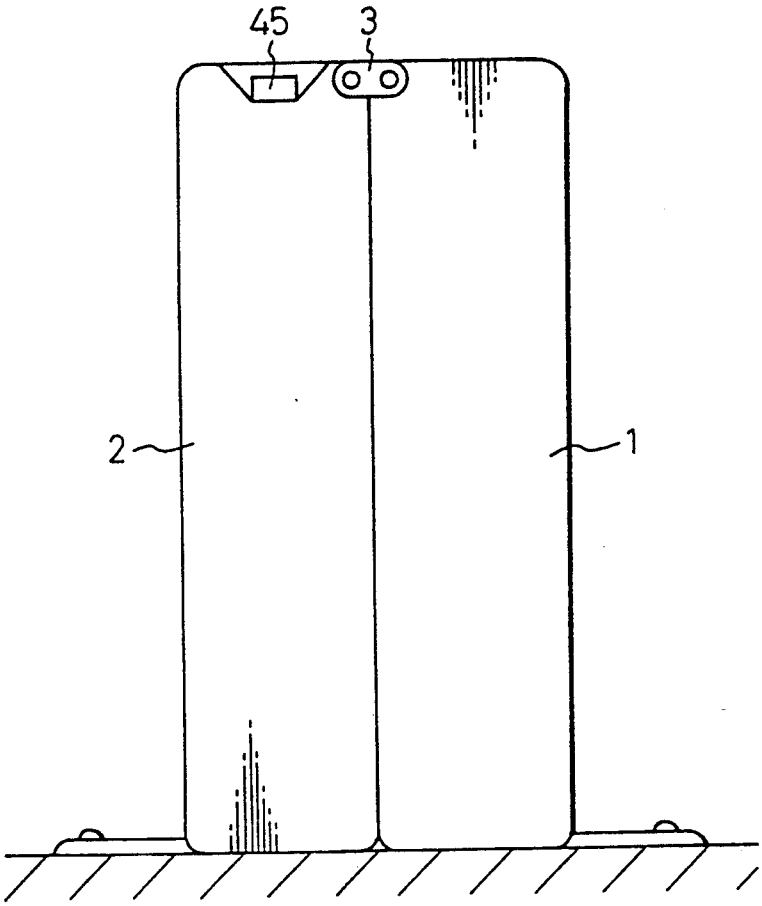
FIG. 15 is a side elevation of the second embodiment of the invention when in a condition of use.
Figure 16:
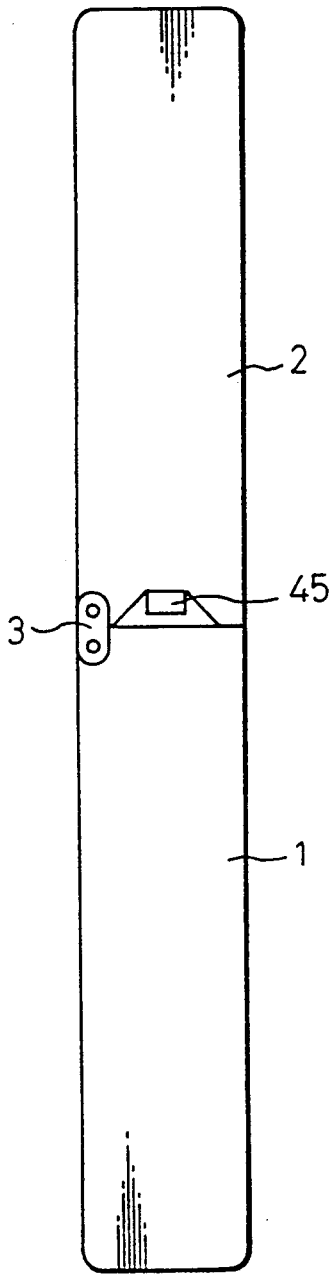
FIG. 16 is a side elevation of the second embodiment of the invention when in a condition of hand-carrying.

FIG. 15 and 16 show the second embodiment of the invention. In contrast to the above-mentioned first embodiment, the hinges 3 are provided on the opposite side. Namely, as shown in FIG. 15, in the closed position when placed vertically, the hinges 3 are located at the upper end. The other portions are the same as in the first embodiment.

With such a construction, as shown in FIG. 16, in the closed position, the power switch 45 is located between the casings 1 and 2 and is not externally accessible. Such an arrangement is advantageous as it avoids the possibility of an unintentional power ON/OFF.

It should be noted that, in the above-mentioned embodiment, a switching between the use condition (closed portion), in which the wider surfaces 1*a* and 2*a* of the casings 1 and 2 are mated, and the carrying condition (open position), in which the casings 1 and 2 are positioned in a flat configuration, is performed by relatively pivoting the cases 1 and 2 about the hinges 3, for an opening and closing thereof. It is possible to connect the casings 1 and 2 by connecting devices other than hinges (for example, a sliding engagement mechanism of the engaging sections), and to change the states of the casings 1 and 2 through actions other than an opening and closing action.

THIRD EMBODIMENT

Figure 17:
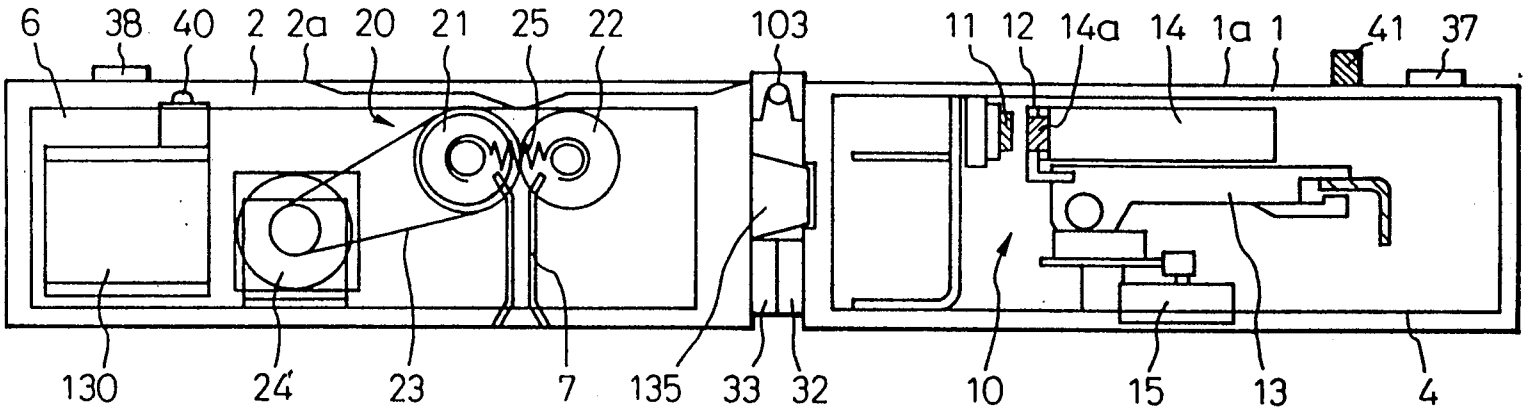
FIG. 17 is a schematic side elevation of the third embodiment of the invention when in a condition of hand-carrying.
Figure 18:
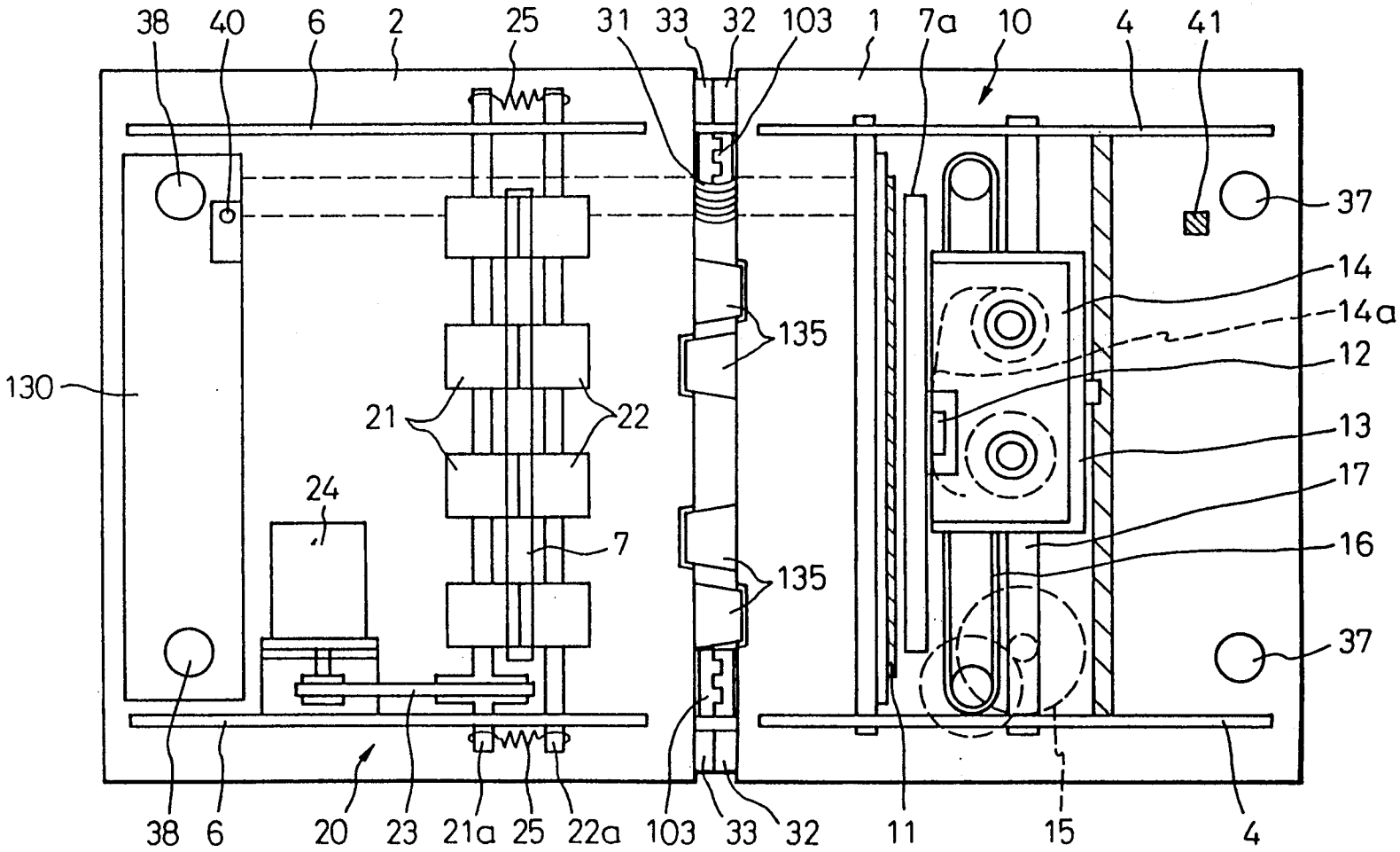
FIG. 18 is a schematic plan view of the third embodiment of the invention when in a condition of hand-carrying.

FIGS. 17 and 18 show the third embodiment of the portable printer according to the present invention, when in the open position. It should be noted that the same references numerals as in the first embodiment represent the same components.

In the drawing, 1 denotes the first casing receiving therein the printing mechanism 10, and 2 denotes the second casing receiving the paper feed mechanism 20.

The platen 11 is rigidly fixed in the first casing 1, and a thermal printing head 12 is arranged in opposition to the platen 11. The printing head 12 is detachably mounted on the carriage 13, as is the ribbon cassette 14. Reference numeral 14*a* denotes the inked ribbon arranged to run from the ribbon cassette 14 across the front face of the printing head 12.

The carriage 12 is driven by the space motor 15, through a drive belt, to travel along the guide shaft 17, and accordingly, the printing head 12 travels along the platen 11, while maintaining a position opposite to the platen 11, to perform a printing of one line.

Reference numeral 4 denotes a pair of side frames for supporting the printing mechanism 10 within the first casing 1, and *7a* denotes a paper feed opening formed in the first casing 1 for feeding the paper across the portion between the platen 11 and the printing head 12.

Further, in the second casing 2, a pair of paper feed rollers 21 and 22 are mounted on the rotary shafts 21*a* and 22*a*. Among these rollers 21, 22, the first paper feed roller 21 is driven by the line feed motor 24 through the drive belt 23, and the second paper feed roller 22 is pressed onto the first paper feed roller 21 by a tension coil spring 25.

Reference numeral 6 denotes a side frame for supporting the paper feed mechanism 20 within the second casing 2, and to denotes a paper feed path defined within the second casing for feeding the paper across the portion between the pair of paper feed rollers 21 and 22.

Numeral 130 denotes a control circuit section housed in the second casing 2. The control circuit section feeds a variety of signals to the space motor 15, the printing head 12, the line feed motor 24 and so forth, through the flexible cable 31, and accordingly, the conductive line will not interfere with the opening and closing of the casings 1 and 2. Also, the conductive line will not be damaged when opening and closing the casings 1 and 2.

The first and second casings 1 and 2 constructed as set forth above are pivotally connected by a pair of hinge joints 103, for a relative pivotal movement thereof, whereby a relative pivoting of the casings 1 and 2 enables an opening and closing thereof.

In the open position as illustrated in FIGS. 17 and 18, the first and second casings 1 and 2 are at 180° from each other and become, in overall construction, a thin flat plate A4 size configuration, for example. Such a configuration facilitates of hand-carrying, carrying in a bag, and a transporting thereof. Also, as it requires less space, a storage thereof becomes easier.

Further, as the printing mechanism 10 is housed in the first casing 1 in a non-separated manner, the important portions, such as the mating surfaces of the platen 11 and the printing head 12 and so forth, are not externally exposed.

This open position can be maintained by the permanent magnet 32 and the steel plate 33 respectively mounted on the mating portions of the casings 1 and 2 and unless a predetermined force is applied to separate the permanent magnet 32 and the steel plate 33, the open position can be stably maintained.

Reference 135 denotes platforms forming legs of the portable printer in the closed position, and two are provided for each of the casings 1 and 2. These platforms 135 may interfere with each other in the open position, and therefore, the casings 1 and 2 are recessed to receive the platforms 135 therein and permit a pivotal motion through an angle of 180°.

Numerals 37 and 38 denote the permanent magnet and the steel strip mounted on the first and second casings 1 and 2 for maintaining the closed position, 40 denotes a switch mounted on the second casing 2 for turning OFF the power at a position other than the closed position, and 41 denotes an actuator projected from the first casing 1 for turning ON the switch 40 in the closed position. At a position other than the closed position, the actuator 41 does not depress the switch 40, and thus the power for the device is maintained OFF and the printing head 12, the space motor 15, the line feed motor 24 and so forth are not activated.

Figure 19:
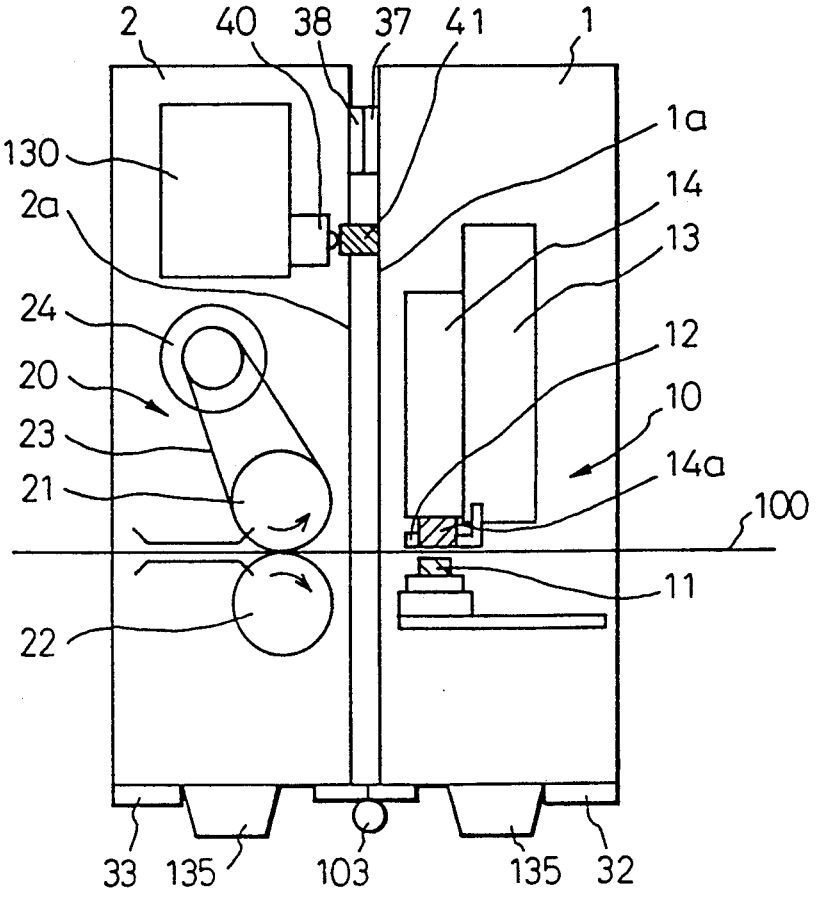
FIG. 19 is a schematic side elevation of the third embodiment of the invention when in a condition of use.

FIG. 19 shows the closed position of the portable printer in a further simplified form than that of FIG. 17.

In the closed position, a gap appears between the platen 11 and the printing head, and the contacting portions of the paper feeder rollers 21 and 22 are positioned opposite to each other so that the paper 100 can be fed between the platen 11 and the printing head 12.

Thus, the platforms 135 serve as legs for supporting the overall construction of the portable printer. The attracting force between the permanent magnet and the steel strip 37 and 38 stably maintains the closed position unless a predetermined force is applied in the opening direction.

Further, as set forth above, the switch 40 is depressed by the actuator 41 to be released from the OFF position. Therefore, by turning ON a separately provided power switch (not shown), the power for the device can be turned ON.

It should be noted that the present invention should not be limited to the foregoing embodiments. For example, any suitable retaining means other than the permanent magnet can be employed for maintaining the casings in the open and closed positions.

EFFECT OF THE INVENTION

With the portable printer according to the present invention, the overall structure is separated into a plurality of casings to thereby form a flat configuration convenient for carrying and transporting, which configuration is different from that when the printer is in use, to facilitate the carrying and transporting thereof. Further, during the carrying and transporting of the printer, the printing mechanism is not externally exposed, and therefore, it is not possible to cause damage to or a staining of the printing mechanism, and thus a good printing quality can be reliably maintained for a long time.

We claim:

1. A portable printer comprising:

a plurality of casings (1, 2);

a printing mechanism (10) housed in said casings (1, 2) for performing a printing of a paper (100); and connecting means (3) for connecting said plurality of casings (1, 2) by mating wider surfaces (1*a* and 2*a*) among outer surfaces of said casings (1, 2) when a printing of said paper (100) by said printing mechanism (10) is performed; and when a printing is not performed, the relative positional relationship to each other of said plurality of said casings (1, 2) can be varied to form an essentially flat configuration overall.

2. A portable printer as set forth in claim 1, wherein said plurality of casings (1, 2) are connected by said connecting means (3) so that said plurality of casings (1, 2) can form the essentially flat configuration overall when a printing of said paper (100) is not performed.

3. A portable printer as set forth in claim 2, wherein said connecting means (3) connects said plurality of casings for an opening and closing thereof.

4. A portable printer as set forth in claim 3, wherein two casings (1, 2) are provided and said two casings (1, 2) are connected at lower ends thereof by said connecting means (3) when a printing is performed.

5. A portable printer as set forth in claim 3 wherein dummy connecting means (9) performing essentially the same action as said connecting means (3) with respect to each of said casings (1, 2) is provided in parallel to said connecting means 3, and a cable (31) for electrical connection between said plurality of casings (1, 2) is inserted through said dummy connecting means (9).

6. A portable printer as set forth in claim 3, wherein said connecting means (3) comprises a twin axle type hinge pivotally journaled on both of said casings (1, 2) to be connected by said connecting means (3).

7. A portable printer as set forth in claim 6, wherein an elastic body (8) is disposed between said twin axle type hinge (3) and said casings (1, 2) for restricting a free motion of said twin axle hinge (3).

8. A portable printer as set forth in claim 1 wherein two casings (1, 2) are provided, said printing mechanism (10) is housed in one of said casings (1), and a paper feed mechanism (20) for feeding said paper (100) is housed in the other casing (2).

9. A portable printer as set forth in claim 8, wherein said casing (1) housing therein said printing mechanism (10) is arranged downstream with respect to a feed direction of said paper (100) by said paper feed mechanism (10), and said casing (2) housing said paper feeder mechanism (20) is arranged upstream thereof.

10. A portable printer as set forth in claim 1, wherein condition holding means (37, 38) are provided for maintaining a condition when wider surfaces (1*a*, 2*a*) among outer surfaces of said plurality of casings (1, 2) are mated to each other.

11. A portable printer as set forth in claim 10, wherein said condition holding means (37, 38) comprises a magnet (37) provided on one of the plurality of adjacent casings (1, 2) and a magnetically conductive member (38) provided on the other casing.

12. A portable printer as set forth in claim 11, wherein said magnet (37) provided on one of said casings (2) is recessed from the surface thereof.

13. A portable printer as set forth in claim 12, wherein said magnetically conductive member (38) is projectably and retractably provided on the other casing (1) with respect to the surface thereof.

14. A portable printer as set forth in wherein a paper feed path (7) for passing said paper (100) therethrough is extended through said two casings (1, 2).

15. A portable printer as set forth in claim 14, wherein slits (7*a*, 7*b*) are formed through said wider surface (1*a*, 2*a*) of said casing at an intermediate position in said paper feed path (7), in alignment with each other, and among said plurality of slits, a slit (7*a*) positioned downstream with respect to the paper feed direction has a wider opening than a slit (7*b*) positioned upstream thereof.

16. A portable printer as set forth in claim 1 wherein support means (35, 36) are provided for supporting said casing (1, 2) when stood on a floor while said wider surfaces (1*a*, 2*a*) of said plurality of casings (1, 2) are mated to each other.

17. A portable printer as set forth in claim 16, wherein said support means (35, 36) is projectably and retractably provided in said casing (1, 2).

18. A portable printer as set forth in claim 1 wherein a ribbon cassette (14) is detachably disposed in said casing (1), in which said printing mechanism (10) is housed, and a closure lid (44) for opening and closing a side wall of said casing (1), for exposing said ribbon cassette (14), is pivotally mounted on said casing (1) to be pivotable about a vicinity of the lower end thereof.

19. A portable printer as set forth in claim 1, 2 or 3, wherein a power switch (45) is provided at a position between said casings (1, 2) and is not externally exposed when said casings (1, 2) are in said essentially flat configuration overall.

20. A portable printer as set forth in any claim 1, wherein a receptacle cover (47) is provided for receiving said plurality of casings (1, 2) when in said flat configuration.

21. A portable printer as set forth in claim 20, wherein a partitioning plate (47*a*) is provided for said receptacle cover (47), for partitioning said casings (1, 2) and other associated materials (48).

* * * * *

UNITED STATES PATENT AND TRADEMARK OFFICE

CERTIFICATE OF CORRECTION

PATENT NO. : 5,236,265

DATED : Aug. 17, 1993

INVENTOR(S) : SAITO et al.

It is certified that error appears in the above-indentified patent and that said Letters Patent is hereby corrected as shown below:

Col. 10, line 49 (Claim 5, line 1), after "3" insert --,--;
line 64 (Claim 8, line 1), after "1" insert --,--.

Col. 11, line 24 (Claim 14, line 1), after "in" insert --claim 1,--.

Col. 12, line 3 (Claim 16, line 1), after "1" insert --,--;
line 24 (Claim 20, line 1), delete "any".

Signed and Sealed this

Sixth Day of May, 1997

Bruce Lehman

*Attest:*

BRUCE LEHMAN

*Attesting Officer*

*Commissioner of Patents and Trademarks*